US007179347B2

(12) United States Patent
Rheims et al.

(10) Patent No.: US 7,179,347 B2
(45) Date of Patent: Feb. 20, 2007

(54) METHOD FOR FIBER STOCK PREPARATION

(75) Inventors: Joerg Rheims, Tönisvorst (DE); Oliver Heise, Menasha, WI (US); Klaus Doelle, Kisslegg (DE); Ronald Sigl, Miesbach (DE); Werner Witek, Appleton, WI (US)

(73) Assignee: VOITH Paper Patent GmbH, Heidenheim (DE)

( * ) Notice: Subject to any disclaimer, the term of this patent is extended or adjusted under 35 U.S.C. 154(b) by 103 days.

(21) Appl. No.: 10/672,817

(22) Filed: Sep. 26, 2003
(Under 37 CFR 1.47)

(65) Prior Publication Data

US 2004/0149403 A1 Aug. 5, 2004

Related U.S. Application Data

(63) Continuation of application No. PCT/EP02/01621, filed on Feb. 15, 2002.

(30) Foreign Application Priority Data

Mar. 29, 2001 (DE) ..... 101 15 421

(51) Int. Cl.
*D21H 17/67* (2006.01)
*D21D 1/20* (2006.01)

(52) U.S. Cl. ..... 162/9; 162/24; 162/181.1; 162/181.4; 162/182; 241/21

(58) Field of Classification Search ..... 162/8–10, 162/57, 158, 261, 182–185, 181.1, 181.2, 162/181.4, 65, 243, 70, 78, 90, 24–28; 241/28, 241/21; 366/303, 304, 305, 307; 106/461, 106/463, 464
See application file for complete search history.

(56) References Cited

U.S. PATENT DOCUMENTS

| | | | | |
|---|---|---|---|---|
| 2,599,093 | A * | 6/1952 | Craig | 162/181.2 |
| 4,229,250 | A | 10/1980 | Lehtinen | 162/23 |
| 4,510,020 | A * | 4/1985 | Green et al. | 162/169 |
| 5,007,985 | A | 4/1991 | Engstrand et al. | 162/26 |
| 5,096,539 | A * | 3/1992 | Allan | 162/9 |
| 5,223,090 | A * | 6/1993 | Klungness et al. | 162/9 |

(Continued)

FOREIGN PATENT DOCUMENTS

| | | |
|---|---|---|
| DE | 2934880 | 11/1980 |

(Continued)

OTHER PUBLICATIONS

Smook, G.A., Handbook for Pulp and Paper Technologists, Chapter 13, pp. 194-208 (1992).*

*Primary Examiner*—Eric Hug
(74) *Attorney, Agent, or Firm*—Taylor & Aust, P.C.

(57) ABSTRACT

A method for the preparation of fiber stock for the production of paper or cardboard, including the steps of:

a) Supplying fibers in the form of a suspension that has a predetermined solids content,
b) Loading of the fibers with a precipitation product, without refining the stock,
c) Refining of the fibers after completion of the loading process, in order to improve the freeness value and/or to alter the fiber characteristics, and
d) Transporting of the fiber stock suspension in direction of the paper machine.

19 Claims, 3 Drawing Sheets

U.S. PATENT DOCUMENTS

| | | | | |
|---|---|---|---|---|
| 5,665,205 | A * | 9/1997 | Srivatsa et al. | 162/181.4 |
| 5,679,220 | A * | 10/1997 | Matthew et al. | 162/181.4 |
| 5,731,080 | A * | 3/1998 | Cousin et al. | 428/372 |
| 5,776,305 | A * | 7/1998 | Sabourin | 162/23 |
| 5,824,364 | A * | 10/1998 | Cousin et al. | 427/212 |
| 5,954,283 | A * | 9/1999 | Matthew | 241/298 |
| 6,059,924 | A * | 5/2000 | Hoskins | 162/9 |
| 6,355,138 | B1 * | 3/2002 | Doelle | 162/9 |
| 6,436,232 | B1 * | 8/2002 | Silenius et al. | 162/9 |
| 6,579,410 | B1 * | 6/2003 | Bleakley et al. | 162/9 |

FOREIGN PATENT DOCUMENTS

| | | |
|---|---|---|
| DE | 69117906 | 5/1996 |
| DE | 19816621 | 4/1999 |
| EP | 0492600 | 12/1991 |

* cited by examiner b knife width (barwidth)
g groove width

θ segment angle
α sector angle
β tooth or knife angle (bar angle)

γ intersecting angle
γ $\alpha_S - \alpha_R$ or
γ $2 \times \alpha$ for $\alpha_S = \alpha_R$

METHOD FOR FIBER STOCK PREPARATION

This is a continuation of prior PCT application No. PCT/EP02/01621, entitled "METHOD FOR PREPARING FIBROUS MATERIAL", filed Feb. 15, 2002.

BACKGROUND OF THE INVENTION

1. Field of the Invention

The present invention relates to a method for the preparation of fiber stock, for the production of paper or cardboard.

2. Description of the Related Art

Fiber stock, for the production of paper and carton cardboard, is processed in the stock preparation that is located prior to the paper machine so that the desired attributes, such as, for example, mechanical characteristics, optical characteristics, etc., are achieved. Especially the mechanical characteristics including consistency characteristics are influenced by the so-called freeness of the fiber stock suspension. This freeness is an indicator as to how easily the fiber stock suspension can be dewatered. A certain level of freeness can be achieved by more or less intensive refining of the fibers in so-called refiners. This involves the fibers being shortened, fibrillated and crushed. This process renders the fibers flexible and increases their specific surface, so that the number of possible bonding points between the fibers is increased during sheet formation. This leads to an increase of the mechanical strength of the paper or carton produced from these fibers. The required refining process uses a considerable amount of energy. Approximately 120 kWhr to 200 kWhr are required per ton of fiber material, depending upon the type of pulp or fiber, the freeness as well as other refining parameters. The conventional method is to refine the fiber stock before, or after, the direct addition of the usual fillers, for example, calcium carbonate, titanium dioxide, etc. The aforementioned high energy volumes are utilized for this.

Loading with a precipitation product, for example a filler, may occur, for example, through a so-called Fiber Loading™ process, as described in U.S. Pat. No. 5,223,090. In this type of "Fiber Loading™" process, an additive, especially a filler, is deposited onto the moistened fiber surfaces of the fibrous material. The fibers may be loaded with calcium carbonate. Moreover, calcium oxide and/or calcium hydroxide are added to the moist, disintegrated fibrous material so that at least a part of this associates itself with the water that is contained in the fibrous material. The so treated fibrous material is subsequently treated with carbon dioxide. In the method that is known from U.S. Pat. No. 5,223,090, the "Fiber Loading™" process can occur inside a refiner.

It is thus a known procedure to subject the stock or pulp to a loading process with which calcium carbonate is produced. However, it remains an open question as to how this treated stock is to be treated optimally, in other words to be refined, with regard to its mechanical, chemical and physical characteristics. What is needed in the art is a more economic and efficient refining process.

SUMMARY OF THE INVENTION

The present invention provides a method that renders a drastic reduction in the refining energy for fiber stock without negatively impacting the characteristics of the paper that is being produced from these fibers.

This method for the preparation of the fiber stock for the production of paper or cardboard, includes the following steps:

a) Supplying of fibers in the form of a suspension that has a predetermined solids content,
b) Loading of the fibers with a precipitation product, without refining the stock,
c) Refining of the fibers after completion of the loading process, in order to improve the freeness value and/or to alter the fiber characteristics, and
d) Transportation of the fiber stock suspension in direction of the paper machine.

This method allows the refining energy, required for fiber stock, to be clearly reduced, at the same time maintaining, almost completely, the desired attributes of the paper that is being produced from these fibers.

In process step a) the solids concentration is selected to be in a range of preferably approximately 25% to approximately 40%, particularly in a range of approximately 30% to approximately 40% and preferably in a range of approximately 30% to 35%.

The precipitation product with which the fibers are loaded in process step c) may be a filler. However, in principle other desired precipitation products are also feasible. When loading the fibers with a filler, such as, calcium carbonate ($CaCO_3$), it can be deposited on the moistened fiber surfaces by adding calcium oxide (CaO) and/or calcium hydroxide ($Ca(OH)_2$) to the moist fiber material. At least a part of the filler can associate itself with the water of the fibrous material volume. The treated fiber material is then additionally treated with carbon dioxide ($CO_2$). Further, the created calcium carbonate may form a suspension around and between the fibers. When adding the medium, containing the calcium oxide and/or the calcium hydroxide, to the fiber stock suspension, a chemical reaction with exothermal characteristics occurs. The calcium hydroxide should preferably be added in a liquid form, also known as milk of lime. This means that the water, that is possibly embedded in or added to the fibrous materials of the fiber stock suspension, is not absolutely necessary for the start and development of the chemical reaction.

The term "moistened fiber surfaces" may encompass all moistened surfaces of the individual fibers. This specifically also includes the scenario where the fibers are loaded with calcium carbonate, or any other desired precipitation product, on their outside surfaces as well as on their inside (Lumen). According to this method the fibers are loaded with the filler calcium carbonate, whereby the loading onto the moistened fiber surfaces occurs through a so-called "Fiber Loading™" process, as described in U.S. Pat. No. 5,223,090. In this "Fiber Loading™" process the carbon dioxide with the calcium hydroxide reacts to form water and calcium carbonate.

Advantageously, the fibrous suspension is diluted, prior to refining, to a solids concentration, defined as the fiber and precipitation product mass, specific to the total volume, in a range of approximately 3% to approximately 7%, especially in a range of approximately 4% to approximately 6% and preferably in a range of approximately 4.5% to approximately 5.5%. With these low concentration levels during the refining process, known as low consistency refining, optimum mechanical strength values, such as tear or break strength, bursting strength, and tensile strength, of the produced paper web is achieved. This also provides the optimum parameters for the refining of pure pulp, without filler content, in order to achieve high mechanical strengths. The refining process may occur in several steps. The concentration of the fiber stock suspension may differ, or be the same in the various refining steps. In certain instances it is advantageous if partial refining occurs prior to the loading of the fibers with filler. Preferably, at most only half of the total refining energy is utilized for refining prior to the loading process. For papers where only small volumes of precipitation products or filler material are desired, at least a part of the precipitation product can be washed out after refining. The expenditure required for this is compensated for by the energy saving during refining.

Optimum refining conditions can be achieved, especially when the fibers are refined in at least one refiner whose refining slot is defined by structured surfaces, whereby the fibers are refined in the refining slot at a specific edge load of the surface structures. A desired range of the edge load is approximately 0.5 J/m to approximately 5 J/m, particularly in a range of approximately 0.5 J/m to approximately 2 J/m and preferably approximately 1.5 J/m. The specific edge load is an internationally common concept. It results from the division of the net-output (Watt) by the total edge length per second (m/s).

The intersection angles of the surface structures that are formed, preferably by a respective toothed or knife filling, are advantageously in a range of approximately 10° to approximately 80°, particularly in a range of approximately 40° to approximately 60° and preferably approximately 40° for short fibers, and approximately 60° for long fibers.

The present method provides a saving in refining energy of 5% to 70%, and in most cases from 20% to 40%, specific to the pure fiber volume. The strengths, optical characteristics, the porosity and the formation of the produced paper are retained, or even improved as compared to the refining of pulp without filler, or where the filler calcium carbonate was added in the conventional way. The present method advantageously can be utilized in the production of papers having a higher filler content, since the filler no longer needs to be washed out.

In particular, the following process sequences are feasible:

Partial refining→"Fiber Loading™" (loading with a filler)→complete refining

Partial refining→"Fiber Loading™" (loading with a filler) and partial refining→complete refining The partial refining prior to the "Fiber Loading™" process is conducted gently, that is with a lower specific stress to the edge load. This causes the fibers to be fibrillated, making the loading process more efficient.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

The following process steps of the present invention are undertaken in the preparation of fiber stock for the production of paper or cardboard:

a) Supplying fibers in the form of a suspension with a predetermined solids concentration;

b) Loading of the fibers with a precipitation product without refining the stock;

c) Refining of the fibers after completion of the loading process, in order to improve the freeness value and/or to change the fiber characteristics; and d) Transportation of the fiber stock suspension in direction of the paper machine, where additional process steps may occur.

In process step a) the solids concentration is selected to be in a range of approximately 25% to approximately 40%, particularly in a range of approximately 30% to approximately 40% and preferably in a range of approximately 30% to 35%. In process step c) the fibers can be loaded with any desired precipitation product, for example a filler. Prior to refining, the solids concentration, defined as the fiber and precipitation product mass, specific to the total volume, can be diluted to be within a range of approximately 3% to approximately 7%, especially to within a range of approximately 4% to approximately 6% and preferably to within a range of approximately 4.5% to approximately 5.5%. The refining process occurs in one or more steps. The concentration of the fiber stock suspension may vary, or be the same, in the various refining steps. A partial refining prior to loading of the fibers with the precipitation product, which may be a filler, is included in the method. For paper, where only small volumes of precipitation products or filler material are desired, at least a part of the precipitation product can be washed out after refining.

Figure 1:
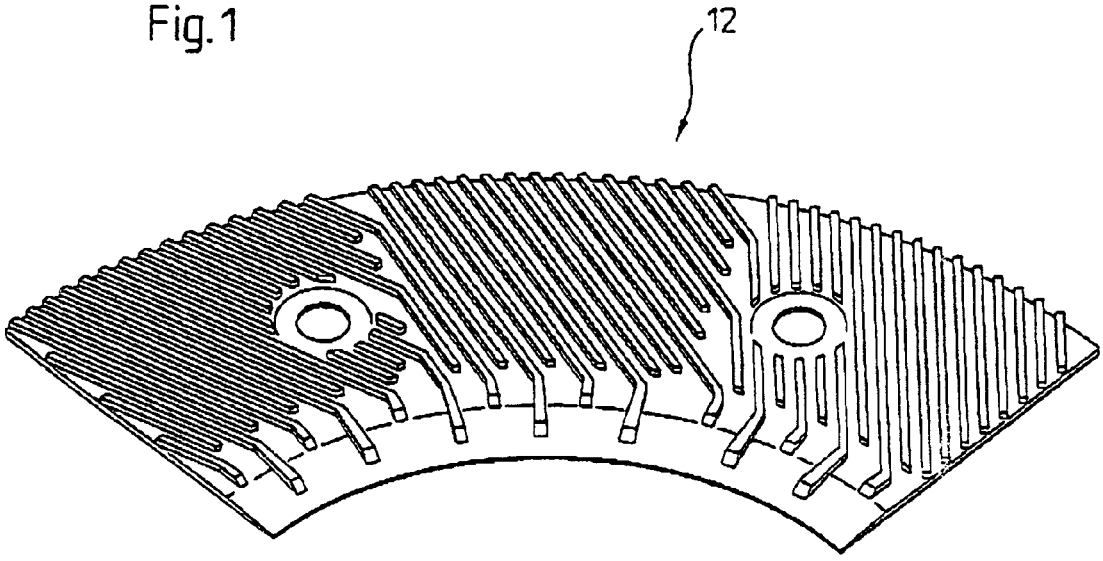
FIG. 1 illustrates a segment of a preferred embodiment of a toothed or knife filling in a refiner of the present invention.
Figure 2:
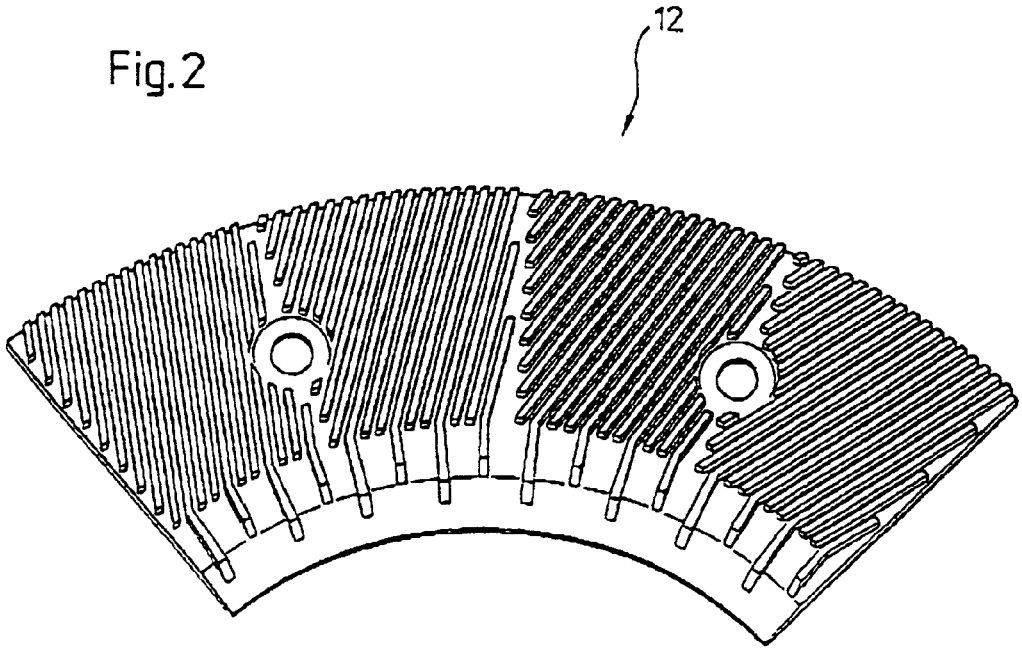
FIG. 2 illustrates a segment of another embodiment of a toothed or knife filling in a refiner of the present invention.

Referring now to the drawings, and more particularly to FIGS. 1 and 2, there is shown a toothed or knife filling 12. The fibers are refined in at least one refiner whose refining slot is defined by structured surfaces that rotate relative to each other and that are formed by respective toothed or knife fillings 12. FIG. 1 illustrates a segment of a preferred embodiment of a toothed or knife filling 12 of a refiner that is utilized for refining the fibers. FIG. 2 depicts an additional possible variation of such a toothed or knife fillings 12. The fibers are refined in the refining slot at a specific edge load of the surface structures in a range of approximately 0.5 J/m to approximately 5 J/m, especially in a range of approximately 0.5 J/m to approximately 2 J/m and preferably approximately 1.5 J/m.

Figure 3:
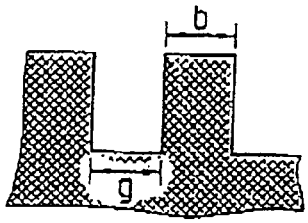
FIG. 3 illustrates an enlarged section of the toothed or knife filling of FIG. 1 or 2.
Figure 4:
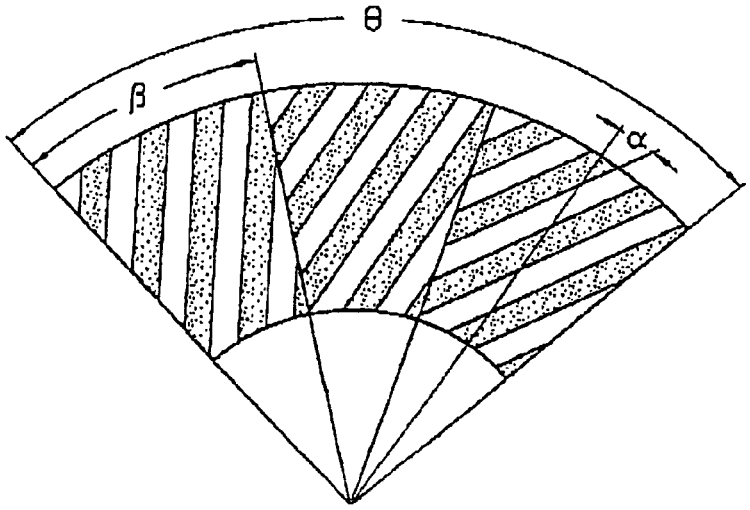
FIG. 4 is a purely schematic illustration of a segment of the toothed or knife filling of FIGS. 1–3, for the purpose of explanation of the angles.

Now, additionally referring to FIGS. 3 and 4 there is shown intersecting angles of the relating toothed or knife fillings 12, which can be in a range of approximately 10° to approximately 80°, especially in a range of approximately 40° to approximately 60° and preferably approximately 40° for short fibers, and approximately 60° for long fibers. As seen in FIG. 4, this intersecting angle is designated as y and is defined as:

$$\gamma=\alpha_s+\alpha_R$$

where $\alpha_s$=knife (bar) angle at the stator $\alpha_R$=knife (bar) angle at the rotor or $$\gamma=2\times\alpha, \text{ for } \alpha_s=\alpha_R$$

The knife (bar) width b of the preferred knife filling 12 illustrated in FIG. 1 equals 3 mm and the intersecting angle γ is 60°. The groove width g is 4 mm. Knife (bar) width b of knife filling 12 illustrated in FIG. 2 is 2 mm and intersecting angle γ is 40°. Groove width g in this instance is 3 mm. In addition to segment angle θ, sector angle β and the tooth or knife angle (bar angle) α can be seen in FIG. 4.

In another embodiment of the present invention, the fiber material is loaded, for example, with calcium carbonate which is a filler. Particularly, calcium oxide and/or calcium hydroxide (slaked lime) can be added to the fiber material in such a way that at least a portion can associate itself with the water that is contained in the fiber material. The association of the filler material occures between the fibers, in the hollow fibers and in their walls, creating the following chemical reaction:

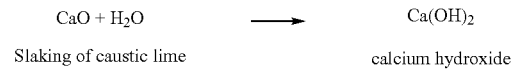

The fiber material is then treated with carbon dioxide ($CO_2$) in the relevant reactor, such that calcium carbonate ($CaCO_3$) is extensively deposited on the moistened fiber surfaces. This results in the following chemical reaction:

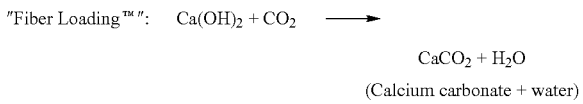

Figure 5:
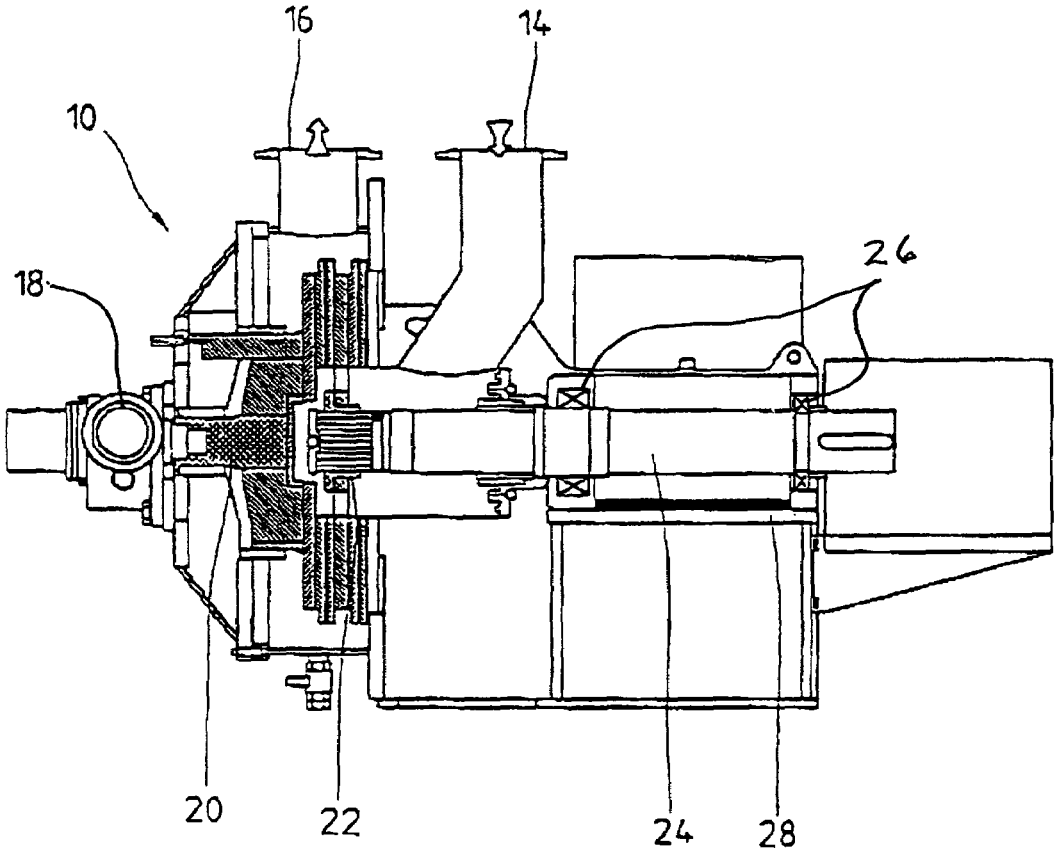
FIG. 5 is a schematic illustration of an exemplary embodiment of a refiner that utilizes the toothed or knife filling of FIGS. 1–4.

Now, additionally referring to FIG. 5, there is shown a schematic illustration of an exemplary embodiment of a refiner 10 that is equipped with a relating refining slot. Refiner 10 includes an inlet 14 and an outlet 16 for the fibers that are to be refined. A spindle gear unit 18 accommodates a spindle through which the refining slot is adjustable (see slot adjustment 20). Rotor 22 is mounted axially movable on the spindle shaft. The rotor 22 is driven through an axially stationary shaft 24 that is mounted in bearings 26. An oil lubrication 28 is also visible in FIG. 5.

In particular, the following process sequences are feasible:

Partial refining→"Fiber Loading™" (loading with a filler)→complete refining

Partial refining→"Fiber Loading™" (loading with a filler) and partial refining→complete refining While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

| Component Identification | |
|---|---|
| 10 | Refiner |
| 12 | Structured surface, toothed or knife filling |
| 14 | Inlet |
| 16 | Outlet |
| 18 | Spindle gear unit |
| 20 | Slot adjustment |
| 22 | Rotor |
| 24 | Shaft |
| 26 | Bearing |
| 28 | Oil lubrication |
| b | Knife width (bar) |
| g | Groove width |
| α | Tooth or knife angle (bar angle) |
| β | Sector angle |
| γ | Intersecting angle |
| θ | Segment angle |
| $\alpha_s$ | Knife (bar) angle at the stator |
| $\alpha_R$ | Knife (bar) angle at the rotor |

What is claimed is:

1. A method of preparing fiber stock for the production of paper or board, comprising the steps of:

supplying fibers in the form of a fiber suspension that has a predetermined solids content, said predetermined solids content being in the range of approximately 25% to approximately 40%;

loading said fibers with a precipitation product, without mechanically treating the fiber stock to improve a freeness value of said fibers;

mechanically treating said fibers after said loading step, whereby said mechanically treating step improves freeness value of said fibers; and transporting of the fiber stock in a direction toward a paper machine.

2. The method of claim 1, wherein said predetermined solids content is in the range of approximately 30% to approximately 40%.

3. The method of claim 2, wherein said predetermined solids content is in the range of approximately 30% to approximately 35%.

4. The method of claim 1, wherein said precipitation product is a filler.

5. The method of claim 1, further comprising the step of washing said precipitation product from said fiber suspension after said mechanically treating step.

6. A method of preparing fiber stock for the production of paper or board, comprising the steps of:

supplying fibers in the form of a fiber suspension that has a predetermined solids content;

loading said fibers with a precipitation product, without mechanically treating the fiber stock to improve a freeness value of said fibers;

mechanically treating said fibers after said loading step, whereby said mechanically treating step improves said freeness value of said fibers;

transporting of the fiber stock in a direction toward a paper machine; and diluting said fiber suspension prior to said mechanically treating step.

7. The method of claim 6, wherein said diluting step results in a change of the solids concentration to be in a range of approximately 3% to approximately 7%, said solids concentration defined as the fiber and precipitation product mass, specific to the total volume.

8. The method of claim 7, wherein said solids concentration is in the range of approximately 4% to approximately 6%.

9. The method of claim 8, wherein said solids concentration is in the range of approximately 4.5% to approximately 5.5%.

10. A method of preparing fiber stock for the production of paper or board, comprising the steps of:

suppling fibers in the form of a fiber suspension that has a predetermined solids content;

loading said fibers with a precipitation product, without mechanically treating the fiber stock to improve a freeness value of said fibers;

mechanically treating said fibers after said loading step, whereby said mechanically treating step improves said freeness value of said fibers;

transporting of the fiber stock in a direction toward a paper machine; and repeating said mechanically treating step.

11. The method of claim 10, wherein said predetermined solids content during a first execution of said mechanically treating step is different than said predetermined solids content in a subsequent execution of said mechanically treating step.

12. The method of claim 10, wherein said predetermined solids content during a first execution of said mechanically treating step is the same as said predetermined solids content in a subsequent execution of said mechanically treating step.

13. A method of preparing fiber stock for the production of paper or board, comprising the steps of:

supplying fibers in the form of a fiber suspension that has a predetermined solids content;

loading said fibers with a precipitation product, without mechanically treating the fiber stock to improve a freeness value of said fibers;

mechanically treating said fibers after said loading step, whereby said mechanically treating step improves said freeness value of said fibers;

transporting of the fiber stock in a direction toward a paper machine; and refining said fiber suspension in at least one refiner having a refining slot, said refining slot having structured surfaces, said fibers present in said refining slot being refined with an edge load of said surface structures in a range of approximately 0.5 J/m to approximately 5.0 J/m.

14. The method of claim 13, wherein said edge load of said surface structures is in a range of approximately 0.5 J/m to approximately 2.0 J/m.

15. The method of claim 14, wherein said edge load of said surface structures is approximately 1.5 J/m.

16. The method of claim 13, wherein said structured surfaces include a plurality of intersecting angles between knife fillings, said plurality of intersecting angles being in the range of approximately 10° to approximately 80°.

17. The method of claim 16, wherein said plurality of intersecting angles are in the range of approximately 40° to approximately 60°.

18. The method of claim 17, wherein said plurality of intersecting angles are approximately 40° if said fibers are short.

19. The method of claim 18, wherein said plurality of intersecting angles are approximately 60° if said fibers are long.

* * * * *

UNITED STATES PATENT AND TRADEMARK OFFICE

CERTIFICATE OF CORRECTION

PATENT NO. : 7,179,347 B2
APPLICATION NO. : 10/672817
DATED : February 20, 2007
INVENTOR(S) : Rheims et al.

It is certified that error appears in the above-identified patent and that said Letters Patent is hereby corrected as shown below:

COLUMN 5
At line 2, please delete "y" and substitute therefore --γ--.

COLUMN 7
At line 11, please delete "suppling" and substitute therefore --supplying--.

Signed and Sealed this

Twentieth Day of November, 2007

JON W. DUDAS
*Director of the United States Patent and Trademark Office*